US005628368A

United States Patent [19]

Sundholm

[11] Patent Number: 5,628,368

[45] Date of Patent: May 13, 1997

[54] FIRE FIGHTING INSTALLATION

[76] Inventor: Göran Sundholm, Ilmari Kiannon kuja 3, FIN-04310 Tuusula, Finland

[21] Appl. No.: 492,033

[22] PCT Filed: Jan. 21, 1994

[86] PCT No.: PCT/FI94/00026

§ 371 Date: Jul. 21, 1995

§ 102(e) Date: Jul. 21, 1995

[87] PCT Pub. No.: WO94/16773

PCT Pub. Date: Aug. 4, 1994

[30] Foreign Application Priority Data

Jan. 21, 1993 [FI] Finland ..... 930234

[51] Int. Cl.[6] ..... A62C 35/62

[52] U.S. Cl. ..... 169/61; 169/65; 169/9; 169/16

[58] Field of Search ..... 169/65, 61, 9, 169/16

[56] References Cited

U.S. PATENT DOCUMENTS

| | | | |
|---|---|---|---|
| 3,865,192 | 2/1975 | Dunphy | 169/61 |
| 3,866,687 | 2/1975 | Banner | 169/61 |
| 3,884,304 | 5/1975 | Messerschmidt et al. | 169/16 |
| 4,082,148 | 4/1978 | Willms | 169/61 |
| 4,356,870 | 11/1982 | Gaylord et al. | 169/65 |
| 4,359,097 | 11/1982 | Claussen | 169/61 |
| 4,830,116 | 5/1989 | Walden et al. | 169/65 |

FOREIGN PATENT DOCUMENTS

| | | | |
|---|---|---|---|
| 406205852A | 7/1994 | Japan | 169/61 |
| 9215370 | 9/1992 | WIPO . | |
| 9220454 | 11/1992 | WIPO . | |
| 9220453 | 11/1992 | WIPO . | |
| 9310859 | 6/1993 | WIPO . | |

*Primary Examiner*—Gary C. Hoge
*Attorney, Agent, or Firm*—Ladas & Parry

[57] ABSTRACT

The object of the invention is to provide new equipment for fighting fire, in particular for restaurant kitchens and similar spaces. A number of automatically releasable spray heads (1) are arranged in the space, and at least one high pressure hydraulic accumulator works as drive unit. When one spray head is released because of a fire broken out, the pressure in the accumulator (2) falls as liquid is sprayed. A pressure gard (4) is arranged to at e.g. 75% of the initial pressure of the accumulator produce a signal to release all spray heads, e.g. by connecting an electric current to heat coils (6) laid around respective release ampoules (5).

5 Claims, 1 Drawing Sheet

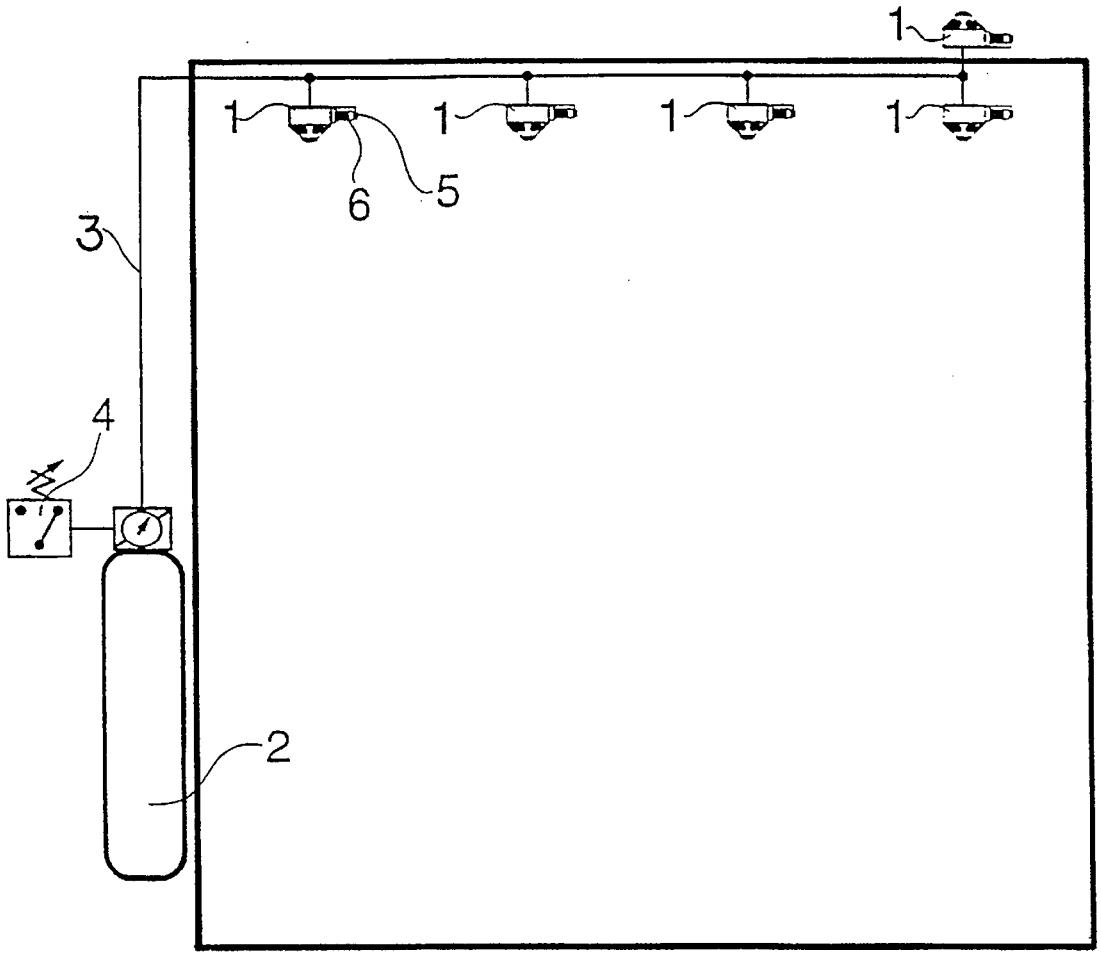
1
1
1
1
1
6
5
3
4
2

FIRE FIGHTING INSTALLATION

The present invention relates to equipment for fighting fire, in particular for kitchen spaces and the like.

Fires in kitchen spaces, in particular in restaurant kitchens and comparable, with friteuses ie. french fryers and other objects liable to fire, are often disastrous.

The object of the invention is to provide new equipment for fighting fire, which is capable of efficiently extinguishing fires in such spaces.

The equipment of the invention comprises a number of preferably automatically releasable spray heads or sprinklers placed at suitable positions and to which extinguishing liquid is arranged to be delivered from at least one hydraulic accumulator preferably having a high charge pressure, e.g. 30–200 bar.

When at least one spray head has been released because of a fire broken out within its action range, the pressure in the hydraulic accumulator starts to decrease as extinguishing liquid is sprayed out of the released spray head. To the hydraulic accumulator is connected a pressure guard which, when the pressure in the hydraulic accumulator has decreased to a predetermined value, e.g. 20 bar and 150 bar, respectively, for the exemplifying limit values of 30 bar and 200 bar, respectively, mentioned above, is arranged to produce a signal in order to release also the other spray heads in the space. The pressure guard can also be arranged to produce a signal to disconnect the electric current to cooking and other apparatuses, as well as a signal for fire alarm.

The spray heads are preferably made according to what is described in the International Patent applications PCT/FI92/00060, PCY/FI/92/00155 and PCT/FI92/00156, in order to produce a fog-like liquid spray with a good penetration power. The drop diameter can preferably be within the interval 30–200 microns.

The release of all spray heads in the space effected by the pressure guard can preferably be arranged to take place by means of heat coils laid around release ampoules of the respective spray heads.

The initially released spray head, utlilizing the full capacity of the hydraulic accumulator, is in general alone capable of extinguishing the fire or at least of suppressing it; the continued spray of liquid with all spray heads prevents the fire from spreading and reignition and brings about general cooling.

The invention shall in the following be described with reference to a preferred embodiment shown in the attached drawing.

In the drawing a number of spray heads, most of which usually are positioned at the ceiling of the space, are indicated by the reference numeral 1. Extinguishing liquid is delivered to the spray heads by at least one hydraulic accumulator 2 via a line 3 in common for the spray heads 1.

A pressure guard connected to the hydraulic accumulator 2 is indicated by 4. The release ampoules of the spray heads 1 are indicated by 5 and a heat coil laid around the respective ampoules is indicated by 6.

The hydraulic accumulator 2 is preferably made according to what is described in the Finnish patent application 924752, with an outlet pipe running within the accumulator and having apertures in its wall, in order to mix drive gas into the extinguishing liquid as the amount of liquid decrases in the accumulator.

The different electrical coupling included in the equipment do not present difficulties for a person skilled in the art and are therefore not shown in the drawing.

I claim:

1. Equipment for fighting fire in a space, comprising: a plurality of automatically releasable spray heads; at least one hydraulic accumulator with a high charge pressure for delivering extinguishing liquid to said spray heads; a pressure guard connected to said hydraulic accumulator for producing a first signal when the pressure in said hydraulic accumulator has decreased to a predetermined value following the release of at least one of said spray heads; and means responsive to said first signal to release the other spray heads in the space.

2. Equipment for fighting fire in a space, according to claim 1, wherein the pressure guard is arranged to produce a second signal for disconnecting the current to electrical apparatuses in the space.

3. Equipment for fighting fire in a space, according to claim 1, wherein the pressure guard is arranged to produce an alarm signal.

4. Equipment for fighting fire in a space, according to claim 1, wherein a release ampule is provided to each of said plurality of spray heads, and further comprising a heat coil laid around each release ampule, whereby said first signal causes said heat coil to activate said release ampule.

5. A fire-fighting system, comprising:

spray heads (1) respectively having release means (5) for releasing extinguishing liquid from the respective spray heads;

hydraulic accumulator means (2,3) for supplying the extinguishing liquid to the spray heads at a pressure, the pressure decreasing after one of the release means has released extinguishing liquid from one of the spray heads;

pressure guard means (4) for providing a signal when the pressure has decreased to a predetermined value; and signal-responsive release means (6) responsive to the signal for releasing the extinguishing liquid from another of the spray heads.

* * * * *